US009257058B2

(12) United States Patent
Sestini

(10) Patent No.: US 9,257,058 B2
(45) Date of Patent: Feb. 9, 2016

(54) ANTI-COUNTERFEIT METHOD AND APPARATUS FOR A DOCUMENT

(75) Inventor: Quirino Fausto Sestini, Bergamo (IT)

(73) Assignee: HUNKELER.IT SR.I, Leghorn (IT)

( * ) Notice: Subject to any disclaimer, the term of this patent is extended or adjusted under 35 U.S.C. 154(b) by 94 days.

(21) Appl. No.: 13/994,211

(22) PCT Filed: Dec. 23, 2011

(86) PCT No.: PCT/IB2011/055946
§ 371 (c)(1),
(2), (4) Date: Jun. 14, 2013

(87) PCT Pub. No.: WO2012/085892
PCT Pub. Date: Jun. 28, 2012

(65) Prior Publication Data

US 2013/0258025 A1 Oct. 3, 2013

(30) Foreign Application Priority Data

Dec. 24, 2010 (IT) ..... PI2010A0141

(51) Int. Cl.
*G07D 7/00* (2006.01)
*B41J 11/66* (2006.01)
*G09F 3/00* (2006.01)

(52) U.S. Cl.
CPC ..... *G09F 3/0297* (2013.01); *G07D 7/0033* (2013.01); *B41J 11/66* (2013.01); *B41J 11/663* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,308,197 | B2 * | 11/2012 | Peters et al. | 283/91 |
| 2009/0072526 | A1 | 3/2009 | Peters et al. | |
| 2010/0043076 | A1 * | 2/2010 | Wesby | 726/26 |

FOREIGN PATENT DOCUMENTS

| | | | | |
|---|---|---|---|---|
| FR | 2825172 | A1 | 11/2002 | |
| JP | 2004178298 | A | 6/2004 | |
| WO | 2008/093093 | A2 | 8/2008 | |
| WO | WO 2010/018449 | * | 2/2010 | B26F 1/20 |

OTHER PUBLICATIONS

International Search Report dated May 10, 2012, corresponding to International Application No. PCT/IB2011/055946.

* cited by examiner

*Primary Examiner* — Huan Tran
(74) *Attorney, Agent, or Firm* — Ladas & Parry LLP

(57) ABSTRACT

An anti-counterfeiting apparatus for a document (10, 70, 90), in particular a credit title, an insurance document, a permit or a transport document (10, 70, 90), comprises a means for printing (25) on said document (10, 70, 90) at least one printed data field in visible characters (12, 14, 17, 19, 72, 92), means for reading (30, 30') the data of said printed data field (12, 14, 17, 19, 72, 92) and means for generating a cutting signal (45) responsive to said reading step (30, 30') of the data of the printed data field (12, 14, 17, 19, 72, 92). Furthermore, it comprises a cutting means of the document (10, 70, 90) in a predetermined zone thereof on the basis of said cutting signal (45). In particular, the cutting means is configured to make on the document, near the printed data field (12, 14, 17, 19, 72, 92), a cut data field (12*a*, 14*a*, 17*a*, 19*a*, 72*a*, 92*a*) in an inerasable and visible way. The cut data field (12*a*, 14*a*, 17*a*, 19*a*, 72*a*, 92*a*) consists of visible cut characters that are a duplication of the data shown of said printed data field (12, 14, 17, 19, 72, 92), that are arranged to allow a visual comparison by a user between said cut data field and said printed data field.

22 Claims, 6 Drawing Sheets

ANTI-COUNTERFEIT METHOD AND APPARATUS FOR A DOCUMENT

This application is a 371 of PCT/IB2011/055946, filed on Dec. 23, 2011, which claims priority to Italian Patent Application No. PI2010A000141, filed on Dec. 24, 2010.

FIELD OF THE INVENTION

The present invention relates to an anti-counterfeit method for a document, in particular a paper document, such as a credit title like a bank cheque, or other types of documents, such as insurance documents for vehicles, transit authorization for vehicles, transport documents for goods, etc.

Furthermore, the invention relates to an apparatus for carrying out said method.

DESCRIPTION OF THE PRIOR ART

As well known, credit institutions such as banks, or other private or public bodies, emit bank cheques like refund cheques, generally bank drafts, which are then sent to their customers, for example to refund money that was paid incorrectly or in surplus, or for other objects.

In particular, refund cheques are generated automatically by a data processing print system that prints the cheque with all the fields filled in, such as the amount to refund and the addressee. Then, these cheques are delivered by mail to the addressee.

It happens, with increasing frequency, that such cheques, normally of low amount, are falsified after mailing. More precisely, once stolen the cheques, falsifiers can change name of the addressee, indicating a fictitious company or a person directly connected to them, which can collect the sum indicated in the cheque.

Such counterfeiting expedient is particularly difficult to discover, unless the addressee reminds the credit institution to send the refund cheque.

In this case, the bank should emit a new refund cheque, with the same risk of not being delivered again.

Other document counterfeiting also occurs, for example, for insurance documents which have to be exposed on vehicles circulating on road. In particular insurance documents are falsified modifying, for example, the date of lapse of the insurance policy, or the number of the contract, or other data.

Even further examples of counterfeited documents are those coming from public institutions or administrations. For example permits for vehicles, such as permits valid in zones where a pass for transit or a permit of a parking permit is required, can be falsified changing the plate or registration number of the vehicle, the documents for carrying goods, etc.

Obviously, there are other examples of documents, generally paper documents, which can be falsified.

Many anti-counterfeiting methods for documents exist, for example watermarks, plasticization or covering layers that cover alterable data fields with a protection film. However, these methods can be easily counterfeited by expert falsifiers by available graphic technologies and systems.

In WO2008093093 an anti-counterfeiting method is described that associates to a document, such as a passport, an identity card or a drivers license, or even a compact-disc, a DVD etc., an univocal number or identification code that certifies its authenticity. In this case, the authenticity of the product can be controlled by a reader that reads the number or identification code that is compared with a database. If two codes coincide the product or document is authentic.

SUMMARY OF THE INVENTION

It is a feature of the present invention to provide an anti-counterfeiting method for a document, for example a credit title, a permit, a transport document or an insurance document, which allows prevents counterfeiting at least one field of the document, such as the fields of the cheque or an ID number or other sensible data.

It is a particular feature of the present invention to provide an anti-counterfeiting method for a credit title, in particular a bank cheque that prevents counterfeiting the field of the cheque.

It is also a feature of the present invention to provide an anti-counterfeiting method for a credit title that can be implemented in a dedicated printing system of the above described credit titles, insurance documents, permits or transport documents.

It is also a feature of the present invention to provide an anti-counterfeiting apparatus for documents that achieves the same objects.

These and other objects are achieved by an anti-counterfeiting method for a document, in particular a credit title, an insurance document, a permit or a transport document, comprising the steps of:

- printing on said document at least one printed data field in visible characters, said printed data field comprising identification data of said document, in particular property data, data of objects or persons, or validity data of said document, etc.;
- reading data of said printed data field;
- generating a cutting signal corresponding to the data read from said printed data field;
- cutting said document in a predetermined zone thereof on the basis of said cutting signal,
- wherein said cutting step comprises a step of creation on said document, near said printed data field, a cut data field in an inerasable and visible way, said cut data field consisting of visible cut characters that are a duplication of the visible characters of said printed data field, and that are arranged to allow a visual comparison by a user between said cut data field and said printed data field.

Advantageously, said cutting step provides the duplication of said characters of said cut data field by perforating said document.

In particular, said perforation is carried out with a plurality of small through holes that describe said characters of said field. This way, it is possible to reproduce on the document cut characters duplicating those of any data field of the document, such as, for example, the addressee field in case of credit titles, or a vehicle registration number, the kind of vehicle and the expiration date, in case of an insurance document or of a parking permit, the identification data of goods or persons, etc., frustrating any possible attempt of counterfeiting the same. The cut data that duplicate the data present in the original document, in fact, jeopardize any possibility of falsifying the document data by simply erasing the original data and reprinting falsified data. In fact, if the characters reprinted in the data field do not coincide with the cut data, there is an apparent evidence of counterfeiting.

In particular, any missing material on the document, either of paper or of plastic, is extremely difficult to replace with other material without that the replacement is visible. In case, instead, the falsification consists of duplicating the whole document, it is necessary that the cut that describes the protected characters is repeated also in the falsified document, with relevant difficulty for falsifiers.

Alternatively, the cutting step provides the duplication of said characters of said cut data field by means of removal of material without perforating the document, in particular colored material is removed from a colored background of said document, in such a way that cut characters are reproduced by means of abrasion of the colored background.

In particular, said cutting step provides, in addition to said duplication of said data field with removal of material, a linear cut to obtain tear-off lines for separating different documents from each other in a continuous printing process.

In a first exemplary embodiment, said reading step provides a step of scanning with optical character recognition of said printed data field on said document, in order to produce a corresponding cutting signal computed starting from said optical recognition. In this exemplary embodiment, there is then an OCR scanning step of at least one field of the preprinted document and a computing step of the scanned data for eventually duplicating the data with incision.

In particular, said reading step provides an OCR scanning of further fields of said document, and said cutting step provides the duplication of said further fields. For example, in a bank cheque, the letters of the amount of the cheque can be duplicated, as well as the figures of the amount of the cheque, whereas in an insurance document or a parking permit, the vehicle registration number and the kind of vehicle, as well as the expiration date can be duplicated. This increases the rate of safety of the document avoiding any possible counterfeiting.

Advantageously, said reading and cutting steps are carried out on a continuous line where a plurality of said documents is supplied as a continuous sequence. In this case, for each document the following steps are carried out: a scanning step of a predetermined data field, an optical recognition of the alphanumerical characters present in said data field, and a following cut suitable for reproducing the characters of the data field with determined cut characters.

In a second exemplary embodiment, said method provides, during said printing step, printing a predetermined activation/command code on said document and said reading step provides the further steps of:

- reading said activation/command code printed on said document in said printing step;
- optically recognizing said activation/command code;
- associating said activation/command code with the identification data of said document,
- generating a cutting signal corresponding to said reading of said activation/command code;
- cutting said document responsive to said cutting signal in order to generate a text/command triggered by said predetermined activation/command code that reproduces said cut data field near said printed data field.

In particular, said cutting step is a laser cutting step that, responsive to said activation/command code, allows creating said cut data field duplicating the same characters of said printed data field. This way, the laser cut responsive to the activation/command code makes it possible to obtain, for each kind of document, a dedicated duplication of the data field.

In particular, said activation/command code contains additional data on the generation of perforation lines for separating portions of documents or for separating adjacent sheets of printed documents on a continuous web of paper. This way, it is possible to provide on the document a desired configuration of the tearing lines.

Advantageously, said activation/command code is an optical code selected from the group consisting of: a bar code, a data matrix or other type.

In particular, the optical code contains data relative both to duplicating a desired data field by cutting with the laser, and to cutting controls for executing on the document, for example, tear lines or clean cuts for separating the many documents from each other.

According to another aspect of the invention, an anti-counterfeiting apparatus for a document, in particular a credit title, an insurance document, a permit or a transport document, comprising:

- a means for printing on said document at least one printed data field in visible characters, said printed data field comprising identification data of said document, in particular property data, data of objects or persons, or validity data of said document, etc.
- a reading means for reading data from said printed data field;
- a means for generating a cutting signal corresponding to the data read from said printed data field;
- a cutting means for cutting said document in a predetermined zone thereof on the basis of said cutting signal,
- wherein said cutting means is arranged to make on said document, near said printed data field, a cut data field in an inerasable and visible way, said cut data field consisting of visible cut characters that are a duplication of the data shown of said printed data field, and that are arranged to allow a visual comparison by a user between said cut data field and said printed data field.

Advantageously, said cutting means is arranged to duplicate said characters of said cut data field by perforating said document.

Alternatively to the perforation, said cutting means is arranged to duplicate the characters of said cut data field by means of removal of material without perforating the document, through a plurality of shallow abrasions of the document, for example in a field on a colored background, so that colored material is removed and the cut characters are reproduced by means of abrasion of the colored background.

In particular, said cutting means is arranged to cut, beyond to the duplication of said data field with removal of material, linear cut lines to obtain tear-off lines for separating different documents from each other in a continuous printing process.

In a first exemplary embodiment, said means for reading is adapted to scan with optical recognition the characters of said printed data field on said document, in order to produce a corresponding cutting signal computed starting from said optical recognition scan.

In particular, said means for reading is adapted to scan further fields of said document and to analyze the relative optical recognition, and said cutting means is arranged to duplicate said further fields.

Advantageously, said means for reading and cutting is adapted to be arranged on a continuous line where a plurality of said documents is provided, such as credit titles, insurance documents or permit documents, transport documents, etc., as a continuous sequence. In this case, for each document the following steps are carried out: scanning a data field of the document, optical recognition of the alphanumerical characters present in said data field and cutting the document to duplicate the characters of the data field with corresponding cut characters.

In a second exemplary embodiment, said means for printing is adapted to print a predetermined activation/command code on said document and said means for reading comprises:

a means for reading said activation/command code printed on said document by said printing means, an optical means for recognizing on said document said activation/command code;

a means for associating said activation/command code with the identification data of said document, a means for generating a cutting signal corresponding to said identification data;

a cutting means for cutting said document responsive to said cutting signal in order to generate a text/command triggered by said predetermined activation/command code that reproduces said cut data field near said printed data field.

In particular, said cutting means is a laser cutting means that, responsive to said activation/command code, creates said cut data field duplicating the same characters of said printed data field.

Advantageously, said activation/command code is an optical code selected from the group consisting of: a bar code, a data matrix or other type.

In particular, the optical codes are configured to contain command data relative both to duplicating by cut a desired data field, by the laser, and to cutting controls for executing on the document, for example, tear lines or clean cuts for separating the many documents from each other.

In particular, said laser cutting means comprises at least one laser head arranged above said document adapted to generate at least one laser beam enclosed in a predetermined cutting area, said laser cutting means being associated with adjustment means of said laser beam that allows adjusting the cutting rate on said document.

This way, it is possible to obtain a more or less pronounced cut, for example responsive to the text to duplicate, for example a duplication with a light abrasion or a duplication with the perforation of the document, or still responsive to the kind of density of the paper document on which the cut is made, or responsive to other parameters.

BRIEF DESCRIPTION OF THE DRAWINGS

The invention will be now shown with the following description of an exemplary embodiment thereof, exemplifying but not limitative, with reference to the attached drawings in which.

finally.

DESCRIPTION OF THE PREFERRED EXEMPLARY EMBODIMENT

Figure 1:
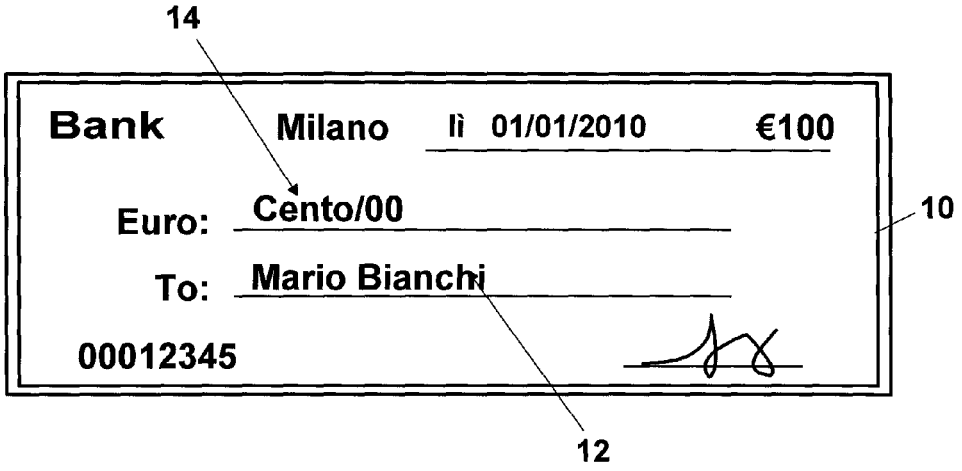
FIG. 1 diagrammatically shows a perspective view of a credit title, in particular a bank cheque.
Figure 2:
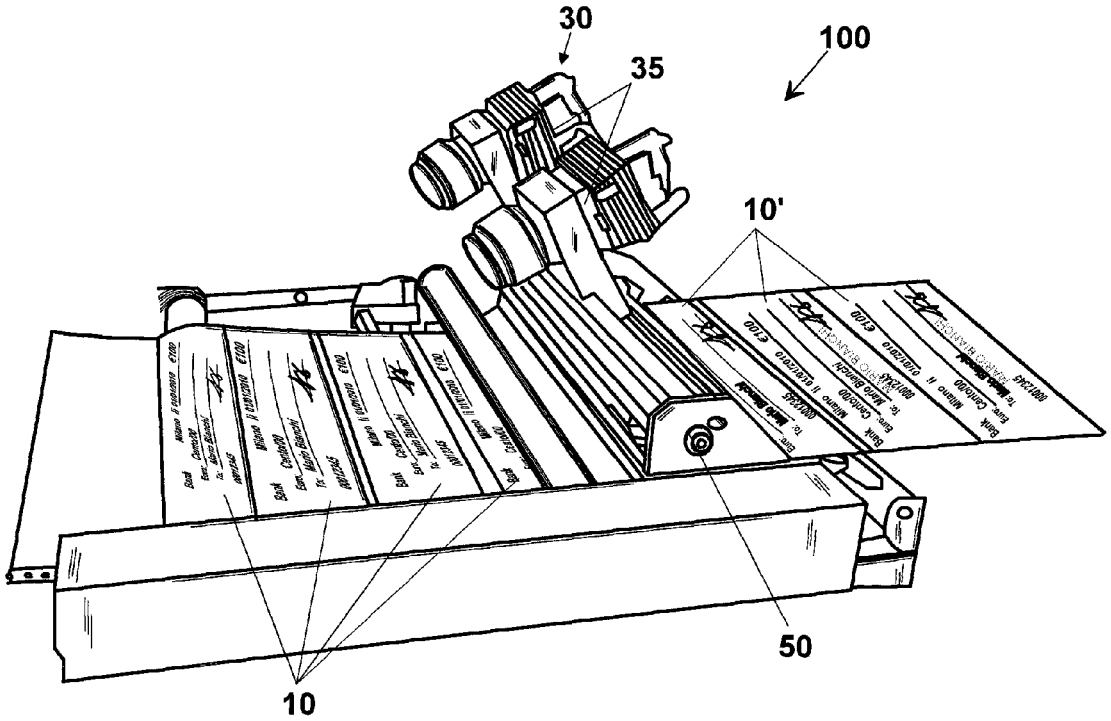
FIG. 2 diagrammatically shows a perspective view of an anti-counterfeiting apparatus of the credit title of FIG. 1 composed by at least one scanner associated with a cutting means.
Figure 10:
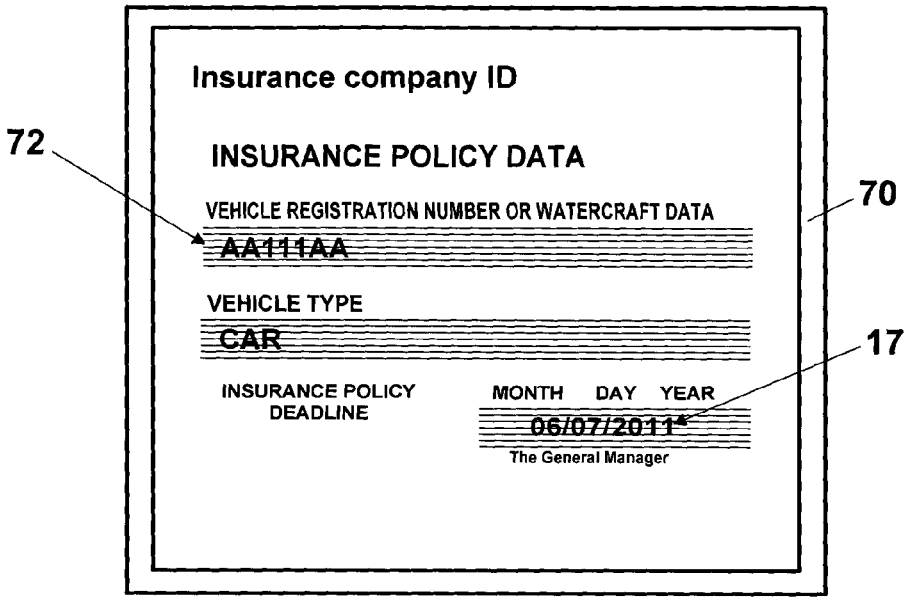
FIGS. 10 and 10A show an top plan view of an insurance document respectively in the original version and in the printed version through the anti-counterfeiting apparatus, according to the invention, where the vehicle registration number and the expiration date of the insurance policy are duplicated by cut.
Figure 11:
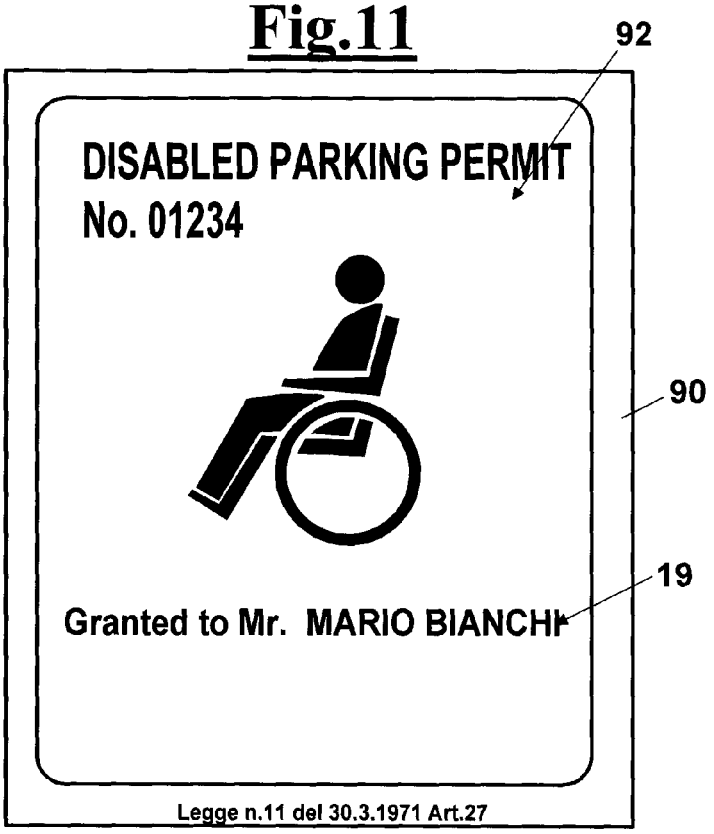
FIGS. 11 and 11A show a top plan view of a document of transit for disables respectively in the original version and in the printed version through the anti-counterfeiting apparatus, according to the invention, where the permit number and the name of the person are duplicated by cut.

With reference to FIGS. 1, and 2, an anti-counterfeiting apparatus is described 100 for a document such as a credit title 10 (FIG. 1), an insurance document 70 (FIG. 10), a permit or a transport document 90 (FIG. 11), for carrying out a method, according to the invention. In particular, the apparatus 100 comprises a printing means 25 (FIG. 4) arranged to print on document 10, 70, 90 in visible characters at least one respective data field 12, 14, 17, 19, 72, or 92 that comprises identification data of document 10, 70 or 90; in particular in case of the document of FIG. 1 the amount and the owner of the credit document. In case of other documents, as described below, such identification data can relate also to features, data of objects or persons, or the expiration date of the document etc.

The apparatus 100 further comprises a means for reading 30, 30' (FIG. 2) data field 12, 14 printed on document 10 and a means 40 (FIG. 3) for generating a cutting signal 45 corresponding the data field 12, 14 acquired by reading means 30/30'.

Figure 3:
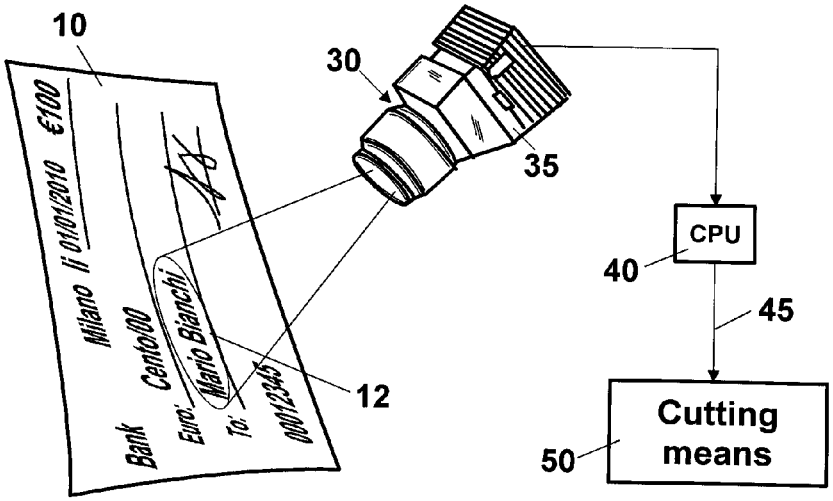
FIG. 3 diagrammatically shows an enlarged view of the scanner arranged to scan the heading field of the credit title associated with means for optical recognition of the character connected to a program unit configured to generate a corresponding cutting signal.
Figure 4:
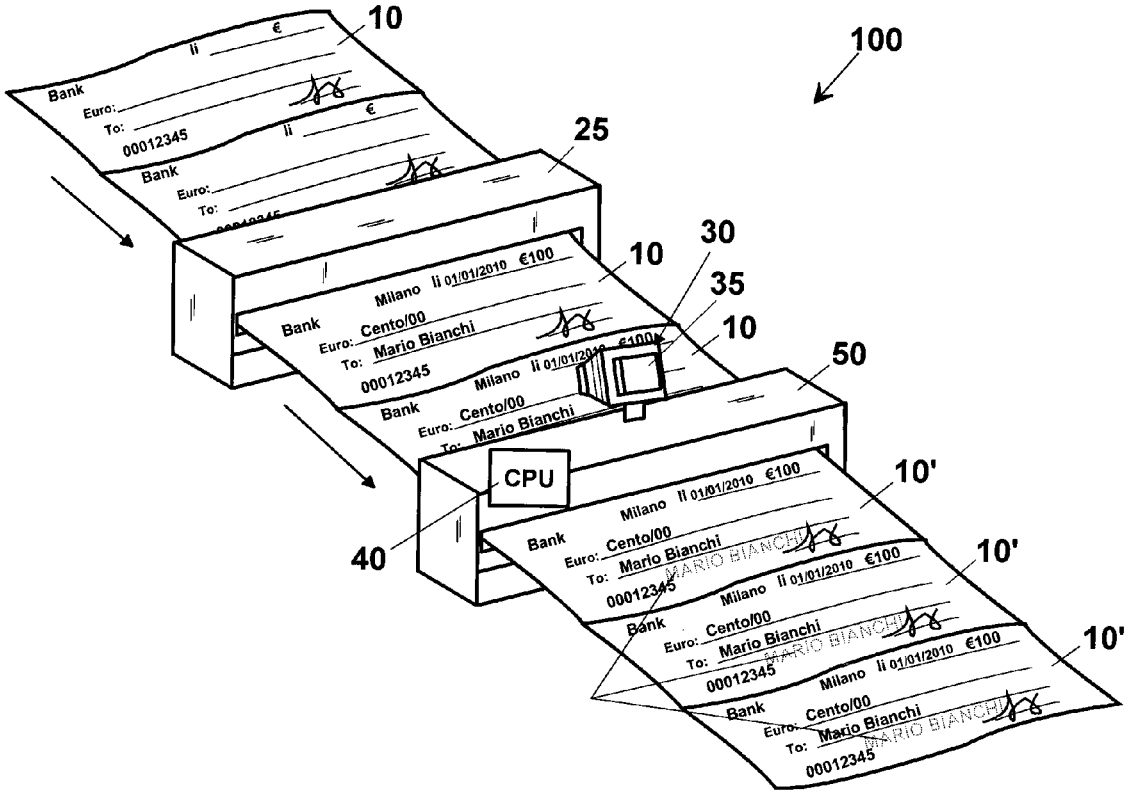
FIG. 4 diagrammatically shows a perspective view of the anti-counterfeiting apparatus, according to the invention, mounted to a continuous printing line.

Furthermore, as shown in FIGS. 2 and 4, the apparatus comprises a means 50 for cutting document 10 in a predetermined zone thereof on the basis of cutting signal 45 (FIG. 3). In particular, cutting means 50 is configured to make on document 10 near the printed data field 12, 14, a cut data field 12*a*, 14*a* (FIGS. 5 and 6), in an inerasable and visible way. Cut data field 12*a*, 14*a*, consists of visible cut characters that are a duplication of the data shown by printed data field 12, 14, and that are described to allow a visual comparison by a user between cut data field 12*a*, 14*a* and printed data field 12, 14. This way, it is possible to reproduce on document 10 cut characters repeating those of data field 12, 14.

Furthermore, other data fields 17, 19, 72, 92 can be printed with relative duplicated cut fields 17*a*, 19*a*, 72*a*, 92*a* as shown below, such as, for example, the proprietor data field of an insurance document or of a parking permit, the identification data of goods or persons, etc., frustrating each possible attempt of counterfeiting the same. Other documents that can be made with this system are for example restaurant tickets.

Figure 10A:
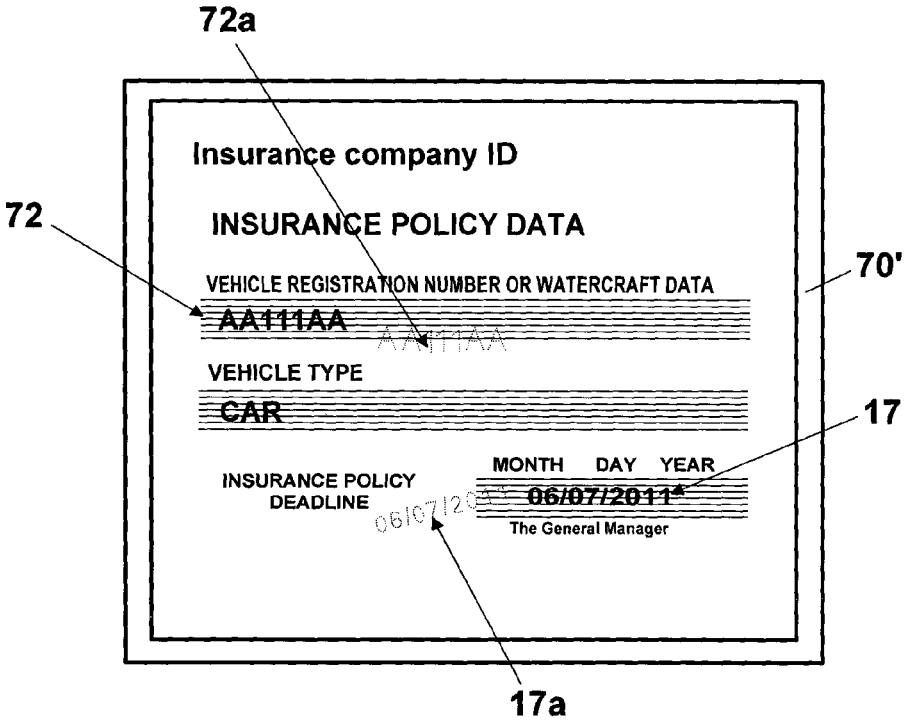
Figure 11A:
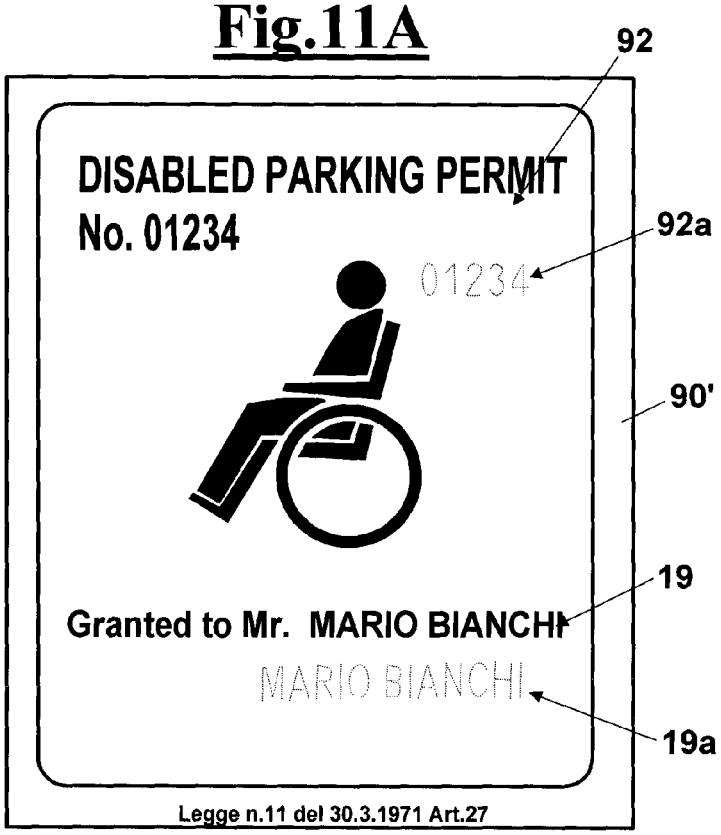

In these cases, a corresponding document 10' (FIG. 6), 70' (FIG. 10A) and 90' (FIG. 11A) will be obtained that comprises the cut data fields 17*a*, 19*a*, 72*a*, 92*a*.

The cut that duplicates the identification data in original document 10, 70, 90, in fact, jeopardizes any possibility of falsifying the document data by simply erasing the original data and reprinting falsified data. In fact, if the characters printed in data field 12, 14, 17, 19, 72, 92 do not coincide with the cut data 12*a*, 14*a*, 17*a*, 19*a*, 72*a*, 92*a*, there is an apparent evidence of counterfeiting. In other words, missing material, on a paper or plastic document, is extremely difficult to replace with other material without that the replacement is visible. In case, instead, the falsification consists of repeating the whole document 10, 70, 90, it is necessary that the cut that describes the protected characters is repeated also in falsified document 10, 70, 90, with relevant difficulty for falsifiers.

In case of controls, it is enough for the controller to check that the characters printed in data field 12, 14, 17, 19, 72, 92 coincide with cut data field 12*a*, 14*a*, 17*a*, 19*a*, 72*a*, 92*a*.

More in detail, in the exemplary embodiment of FIGS. 2 and 3, reading means 30 is represented by a scanner 35 with optical recognition of the characters of data field 12, 14, 17, 19, 72, 92 preprinted on document 10, 70, 90, such that a corresponding cutting signal 45 can be computed starting from the optical recognition. More in particular, scanner 35 carries out an OCR job of the text present in the addressee data field 12 of the credit title 10 (FIG. 3) and/or in another field, recognizing a desired font of alphanumerical characters, comprised also handwriting.

In detail, as shown in FIG. 3, the means for generating the cutting signal are shown by a program unit 40 capable of storing the data produced by scanner 35 and to carry out the conversion with optical recognition that can be transmitted to cutting means 50. In particular, cutting means 50 can be selected from the group consisting of: perforating means for perforating the characters on document 10, 70, 90, or alternatively to the perforation a means for removing material without perforating document 10, 70, 90, through a plurality of shallow abrasions of document 10, 70, 90, for example in a field on a colored background, so that the means for abrasion remove the color and the characters are reproduced by means of abrasion of the colored background.

Figure 5:
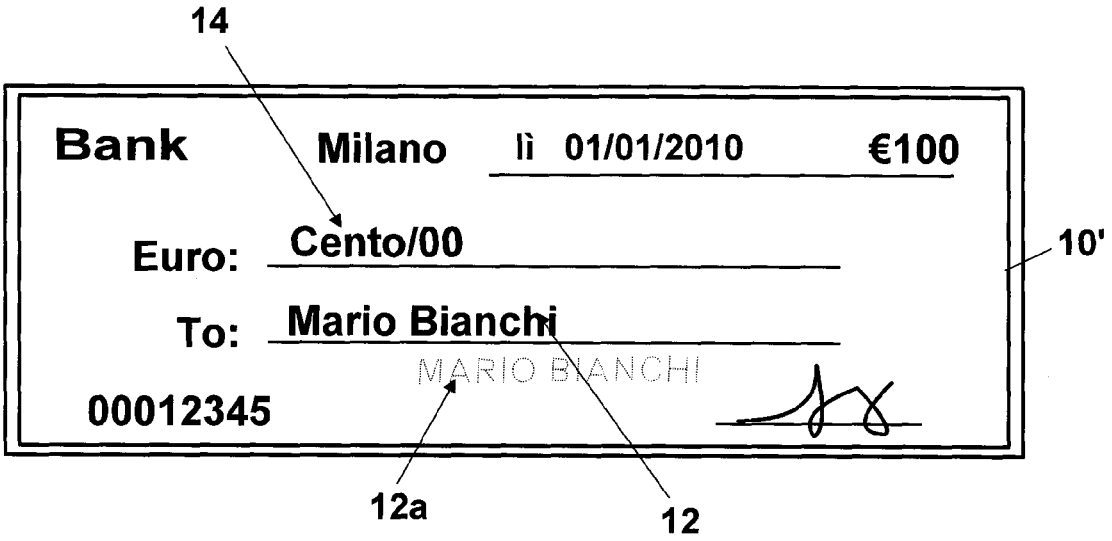
FIG. 5 diagrammatically shows a perspective view of a credit title at the outlet of the anti-counterfeiting apparatus where it is shown the text duplicated by cutting of the addressee data field.
Figure 6:
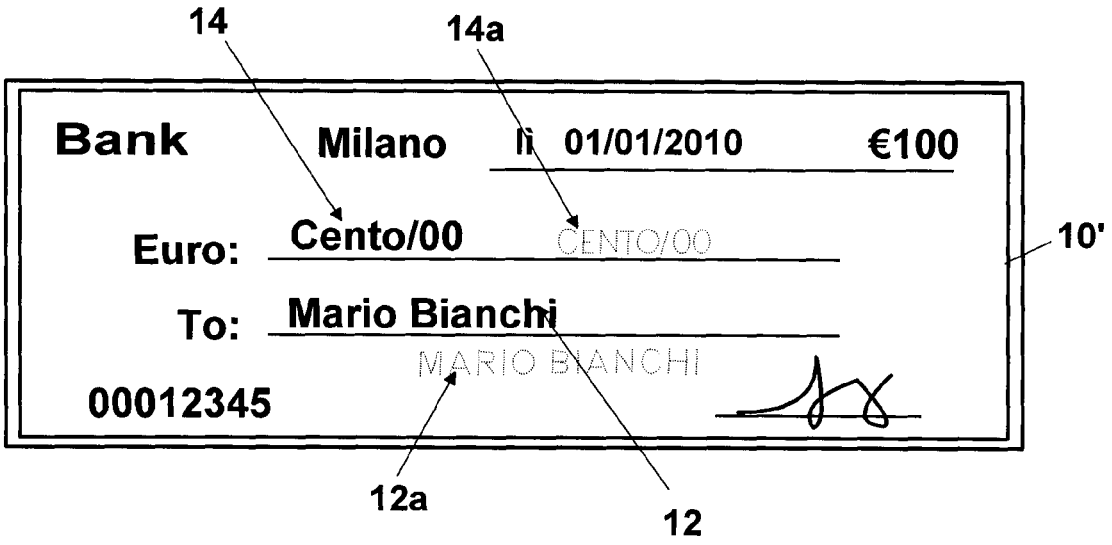
FIG. 6 diagrammatically shows a perspective view of an exemplary embodiment of the credit title at the outlet of the anti-counterfeiting apparatus where it is shown duplicating by cut a desired addressee data field and a further field, for example the field of the cheque amount in writing.

In particular, scanning means 35 is configured to scan contemporaneously also further fields 14 of document 10 and to analyze the relative optical recognition data, and cutting means 50 is configured to duplicate further fields 14 by cutting. For example, in a bank cheque, as shown in FIGS. 5 and 6, the amount in writing of the cheque 14 can be duplicated, by cut characters 14*a*, as well as it amount in figures, whereas in an insurance document or a parking permit 70, the vehicle registration number 72, 72*a* (FIG. 10A) or the permit number 92, 92*a* or the kind of vehicle, as well as the expiration date 17, 17*a* (FIG. 11A) and the proprietor data field 19, 19*a* can be duplicated. This increases the rate of safety of document 10, 70, 90 avoiding any possible counterfeiting.

Figure 7:
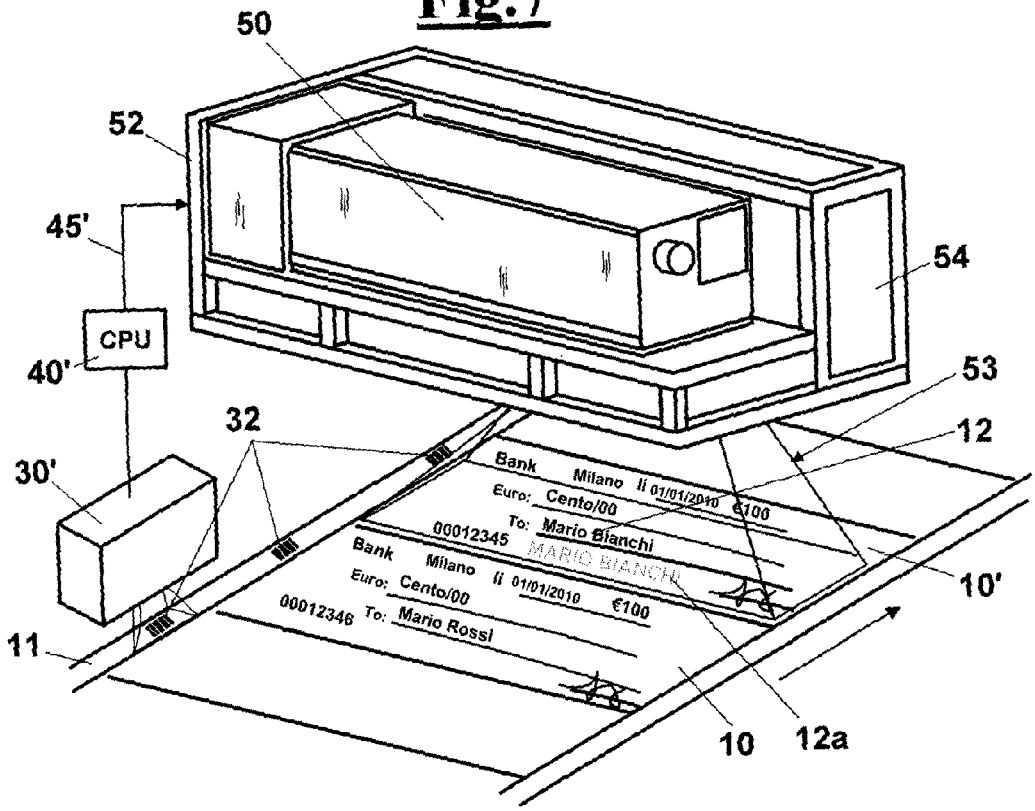
FIG. 7 diagrammatically shows a perspective view of an exemplary embodiment of the apparatus that provides reading an activation/command code that generates a corresponding cutting signal transmitted to laser cutting means.

As shown in FIG. 7, reading means 30, 30' and the means for cutting 50 are configured to be arranged on a continuous line where a plurality of documents 10, 70, 90 is conveyed, such as credit titles 10, insurance documents 70 or permit documents 90, transport documents, etc. as a continuous sequence. In this case, for each document 10, 70, 90 the following steps are carried out: a scanning step of the data of printed data field 12, 14, 17, 19, 72, 92 of document 10, 70, 90, an optical recognition of the visible characters present in data field 12, 14, 17, 19, 72, 92 and a following cutting step, suitable for duplicating the characters of the printed data field as cut characters 12*a*, 14*a*, 17*a*, 19*a*, 72*a*, 92*a*.

Figure 8:
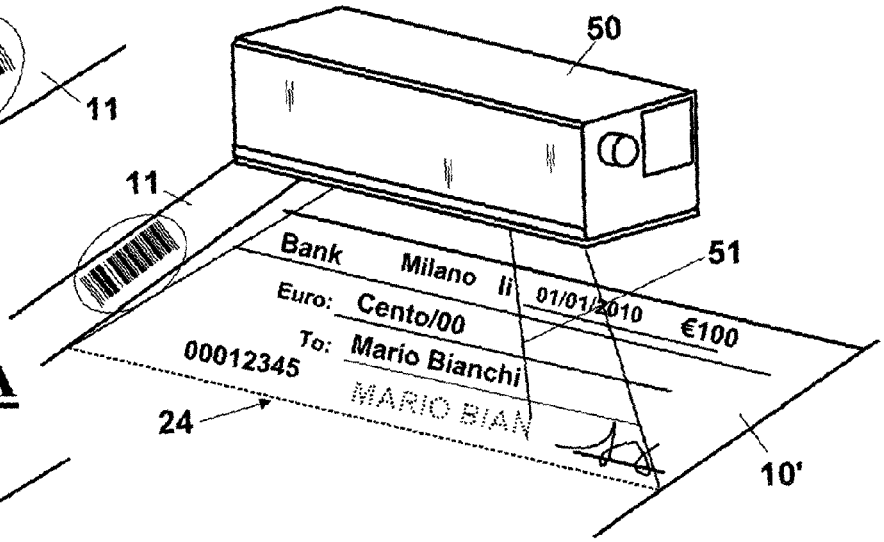
FIG. 8 shows in a detailed view the apparatus of FIG. 7, depicting the action of a laser beam during the cut of the addressee data field of a credit title.

In addition, as shown in FIG. 8, cutting means 50 is configured for both duplicating data field 12, 14, 17, 19, 72, 92 with removal of material, and for making a linear cut to obtain tear-off lines 24 for separating different documents from each other in a continuous printing process.

Figure 9:
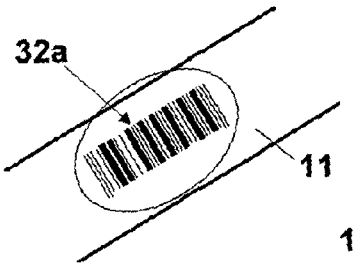
FIGS. 9 and 9A show two exemplary embodiments of the activation/command codes printed at the side edges of the document.
Figure 9A:
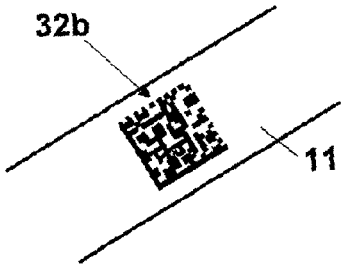

Always as shown in FIGS. 7 and 8, continuous printing means 25 is configured to print a predetermined activation/command code 32, better shown in FIGS. 9 and 9A, of document 10, 70, 90 and reading means 30, 30' is configured to read the activation/command code 32 imparted on document 10, 70, 90 by the printing means.

In particular, the activation/command code 32 is printed on a side portion 11 of the document that eventually is torn off from the document.

Furthermore, the means for generating 40' is configured to generate a cutting signal 45' responsive to the read activation/command code 32, and cutting means 50 is configured to cut document 10, 70, 90 on the basis of cutting signal 45' in order to generate a text to cut, which is driven by the predetermined activation/command code 32, as shown in FIG. 8.

In particular, cutting means 50 is a laser cutting means that, responsive to activation/command code 32, creates cut data field 12*a*, 14*a*, 17*a*, 19*a*, 72*a*, 92*a* that duplicates printed data field 12, 14, 17, 19, 72, 92, and can also create a cutting line 24 between the many documents. More precisely, the activation/command code 32, is an optical code selected from the group consisting of: a bar code 32*a* (FIG. 9), a data matrix 32*b* (FIG. 9A) or other code type.

In particular, optical codes 32 can contain command data relative both to duplicating by cut a desired data field 12, 14, 17, 19, 72, 92, by laser 50, and to cut document 10, 70, 90 according to cutting lines 24, as tear-off lines or clean cuts, for separating the many documents from each other. This way, the laser cutter is responsive to the activation code, and driver 32 makes it possible to obtain, for each kind of document 10, 70, 90, a dedicated duplication of data field 12, 14, 17, 19, 72, 92 or a dedicated configuration of the tearing lines. In other words, the use of the activation/command codes allows, furthermore, to carry out different operations for each paper document on a same printing line.

More in particular, the laser cutting means comprises at least one laser head 50 arranged, by a special support frame 52, above document 10, 70, 90 and adapted to generate at least one laser beam 51 enclosed in a predetermined cutting area 53 (FIG. 7). Laser head 50 is, furthermore, associated with adjustment means 54 for adjusting laser beam 51 in order to adjust in turn the cutting rate on document 10, 70, 90. This way, it is possible to obtain a more or less pronounced cut, for example responsive to the text to duplicate, which can be also a duplication with a light abrasion or a duplication with the perforation of document 10, 70, 90, or even responsive to the kind of density of the material of document 10, 70, 90 on which the cut is made, or responsive to other parameters.

The foregoing description of specific exemplary embodiments will so fully reveal the invention according to the conceptual point of view, so that others, by applying current knowledge, will be able to modify and/or adapt in various applications this specific exemplary embodiments without further research and without parting from the invention, and, then it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. An anti-counterfeiting method for a document, the method comprising the steps of:

printing on said document at least one printed data field in visible characters, said printed data field comprising identification data of said document;

reading the data of said printed data field;

generating a cutting signal corresponding to said reading step of the data of said printed data field;

cutting said document in a predetermined zone thereof on the basis of said cutting signal, wherein said cutting step comprises a step of creation on said document, near said printed data field, of a cut data field in an inerasable and visible way, said cut data field consisting of visible cut characters that are a duplication of the visible characters of said printed data field, that are arranged to allow a visual comparison by a user between said cut data field and said printed data field; and wherein said reading step, and cutting step are carried out on a continuous line where a plurality of said documents is supplied as a continuous sequence.

2. The method according to claim 1, wherein said cutting step provides the duplication of said characters of said cut data field by perforating said document.

3. The method according to claim 1, wherein said cutting step provides the duplication of the characters of said cut data field by means of removal of material without perforating the document, by making a plurality of shallow abrasions not passing through the document, in such a way that cut characters are reproduced by means of abrasion of the colored background.

4. The method according to claim 3, wherein said plurality of shallow abrasions are made on a colored background of said document from which colored material is removed.

5. The method according to claim 1, wherein said reading step provides a step of scanning with optical character recognition of said printed data field on said document, in order to produce a corresponding cutting signal computed starting from said optical recognition.

6. The method according to claim 1, wherein said method during said printing step provides printing a predetermined activation/command code of said document and said reading step comprises the further steps of:

reading said activation/command code printed on said document in said printing step;

optically recognizing said activation/command code;

associating said activation/command code with the identification data of said document, generating a cutting signal corresponding to said identification data;

cutting said document responsive to said cutting signal in order to generate a text/command triggered by said predetermined activation/command code that duplicates said cut data field near said printed data field.

7. The method according to claim 6, wherein said cutting step is a laser cutting step that, responsive to said activation/command code, allows creating said cut data field duplicating the same characters of said printed data field.

8. The method according to claim 6, wherein said activation/command code contains additional data on the generation of perforation lines for separating portions of document or for separating adjacent sheets of printed documents on a continuous web of paper.

9. The method according to claim 1, wherein said identification data comprises property data, data of objects or persons, or validity data.

10. The method according to claim 1, wherein said perforating step is carried out by providing a plurality of small through holes that describe said characters of said field.

11. The method according to claim 1, wherein the document is a credit title, an insurance document, a permit, or a transport document.

12. An anti-counterfeiting apparatus for a document, the apparatus comprising:

a printing means for printing on said document at least one printed data field in visible characters, said printed data field comprising identification data of said document;

a reading means for reading the data from said printed data field;

a means for generating a cutting signal corresponding to said reading step of the data of said printed data field;

a cutting means for cutting said document in a predetermined zone thereof on the basis of said cutting signal, wherein said cutting means is arranged to cut on said document, near said printed data field, a cut data field in an inerasable and visible way, said cut data field consisting of visible cut characters that are a duplication of the data shown of said printed data field, that are arranged to allow a visual comparison by a user between said cut data field and said printed data field.

13. The apparatus according to claim 12, wherein said cutting means is arranged to duplicate said characters of said cut data field and wherein said cutting means perforates said document.

14. The apparatus according to claim 12, wherein said cutting means is arranged to duplicate the characters of said cut data field, by means of removal of material without perforating the document, by making a plurality of shallow abrasions not passing through the document, in such a way that cut characters are reproduced by means of abrasion of the colored background.

15. The apparatus according to claim 14, wherein said plurality of shallow abrasions are made on a colored background of said document from which colored material is removed.

16. The apparatus according to claim 12, wherein said means for reading is configured to scan with optical recognition the characters of said printed data field on said document, in order to produce a corresponding cutting signal computed starting from said optical recognition.

17. The apparatus according to claim 12, wherein said printing means is configured to print a predetermined activation/command code on said document and said means for reading comprises:

a means for reading said activation/command code printed on said document by said printing means;

an optical means for recognizing on said document said activation/command code;

a means for associating said activation/command code with the identification data of said document, a means for generating a cutting signal corresponding to said identification data;

a means for cutting said document responsive to said cutting signal in order to generate a text/command triggered by said predetermined activation/command code that duplicates said cut data field near said printed data field.

18. The apparatus according to claim 17, wherein said cutting means is a laser cutting means that, responsive to said activation/command code, creates said cut data field duplicating the same characters of said printed data field.

19. The apparatus according to claim 18, wherein said laser cutting means comprises at least one laser head arranged above said document adapted to generate at least one laser beam enclosed in a predetermined cutting area, said laser cutting means being associated with adjustment means of said laser beam that allows adjusting the cutting rate on said document.

20. The apparatus according to claim 12, wherein the document is a credit title, an insurance document, a permit, or a transport document.

21. The apparatus according to claim 12, wherein said identification data comprises property data, data of objects or persons, or validity data.

22. The apparatus according to claim 12, wherein said, wherein, when said cutting means perforates said document, said document includes a plurality of small through holes that describe said characters of said field.

* * * * *